US007401858B2

(12) United States Patent
Lee

(10) Patent No.: US 7,401,858 B2
(45) Date of Patent: Jul. 22, 2008

(54) CHAIR HAVING AUTOMATICALLY ADJUSTABLE BACKREST

(75) Inventor: Jong-Ho Lee, Kyoungsangnam-do (KR)

(73) Assignee: Manplus Co., Ltd., Changwon-Si (KR)

( * ) Notice: Subject to any disclaimer, the term of this patent is extended or adjusted under 35 U.S.C. 154(b) by 275 days.

(21) Appl. No.: 10/557,609

(22) PCT Filed: May 20, 2004

(86) PCT No.: PCT/KR2004/001201

§ 371 (c)(1),
(2), (4) Date: Nov. 22, 2005

(87) PCT Pub. No.: WO2004/107917

PCT Pub. Date: Dec. 16, 2004

(65) Prior Publication Data

US 2007/0069564 A1 Mar. 29, 2007

(30) Foreign Application Priority Data

May 23, 2003 (KR) ..... 10-2003-0032799
May 12, 2004 (KR) ..... 10-2004-0033481

(51) Int. Cl.
*B60N 2/02* (2006.01)
*A47C 1/00* (2006.01)

(52) U.S. Cl. ..... 297/383; 297/316; 297/340; 297/344.19

(58) Field of Classification Search ..... 297/383, 297/316, 340, 344.12, 344.19
See application file for complete search history.

(56) References Cited

U.S. PATENT DOCUMENTS 1,685,770 A * 10/1928 Bowen ..... 297/326
5,377,216 A * 12/1994 Nilsen et al. ..... 372/58
5,421,640 A * 6/1995 Bauer et al. ..... 297/372
5,516,197 A * 5/1996 Condos ..... 297/344.18
5,902,013 A * 5/1999 Hong ..... 297/383
6,033,021 A 3/2000 Udo et al.
6,422,649 B2 7/2002 Hancock

FOREIGN PATENT DOCUMENTS

DE 26 42 091 A1 3/1978
JP 8-294428 A 11/1996

* cited by examiner

*Primary Examiner*—Sarah B McPartlin
(74) *Attorney, Agent, or Firm*—Birch, Stewart, Kolasch & Birch, LLP

(57) ABSTRACT

A system and method are presented for discovering mobile collaborators on a peer-to-peer (P2P) network. Each collaborator is identified on the P2P network by a unique ID. Each collaborator may also be identified by an identity file posted on the P2P network. Collaboration applications may include any of a variety of applications involving the exchange of information between 2 or more collaborators, such as voice over IP (VoIP). Dynamic file querying can be performed to filter the identity files most relevant to a particular peer partner. Web services are used end-to-end between P2P mobile devices and also between devices and third party service providers. Search engines use self-provisioning concepts for searches and WEB services querying. End-user devices register their personal information on P2P networks using identity self-provisioning and WEB services templates for a variety of uses, such as personal, gaming or business.

8 Claims, 10 Drawing Sheets

[Fig. 1]
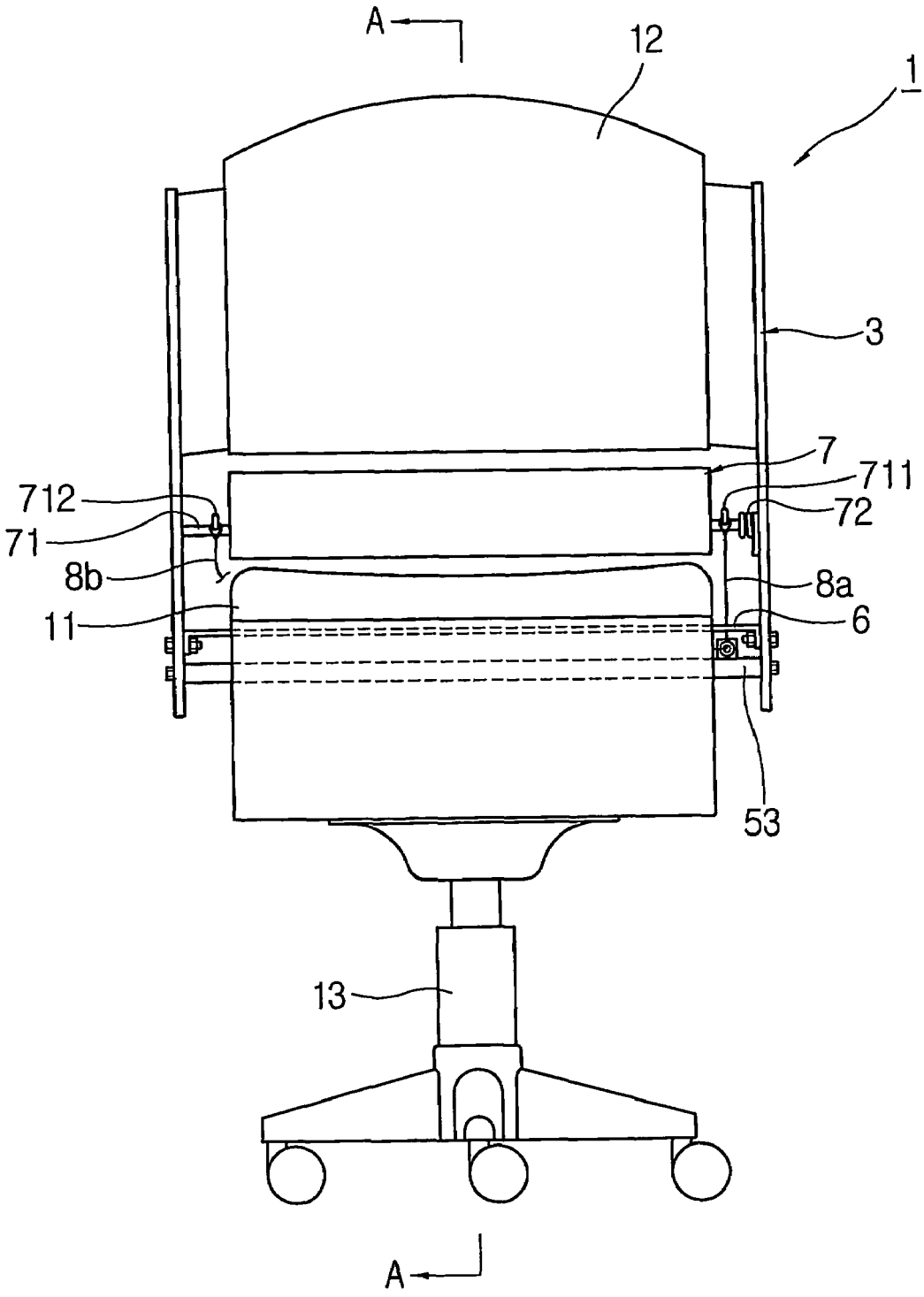

[Fig.2]
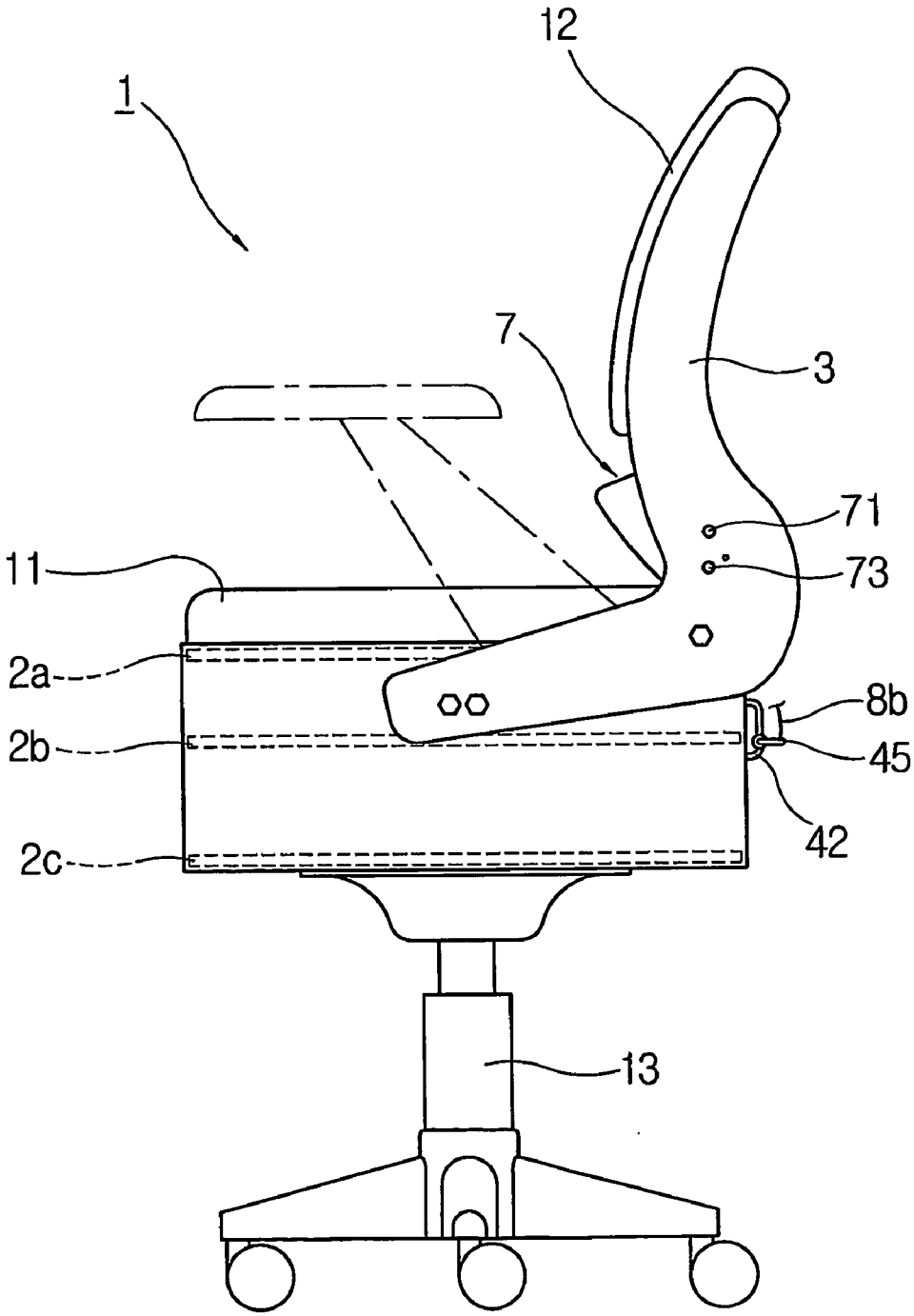

[Fig.3]
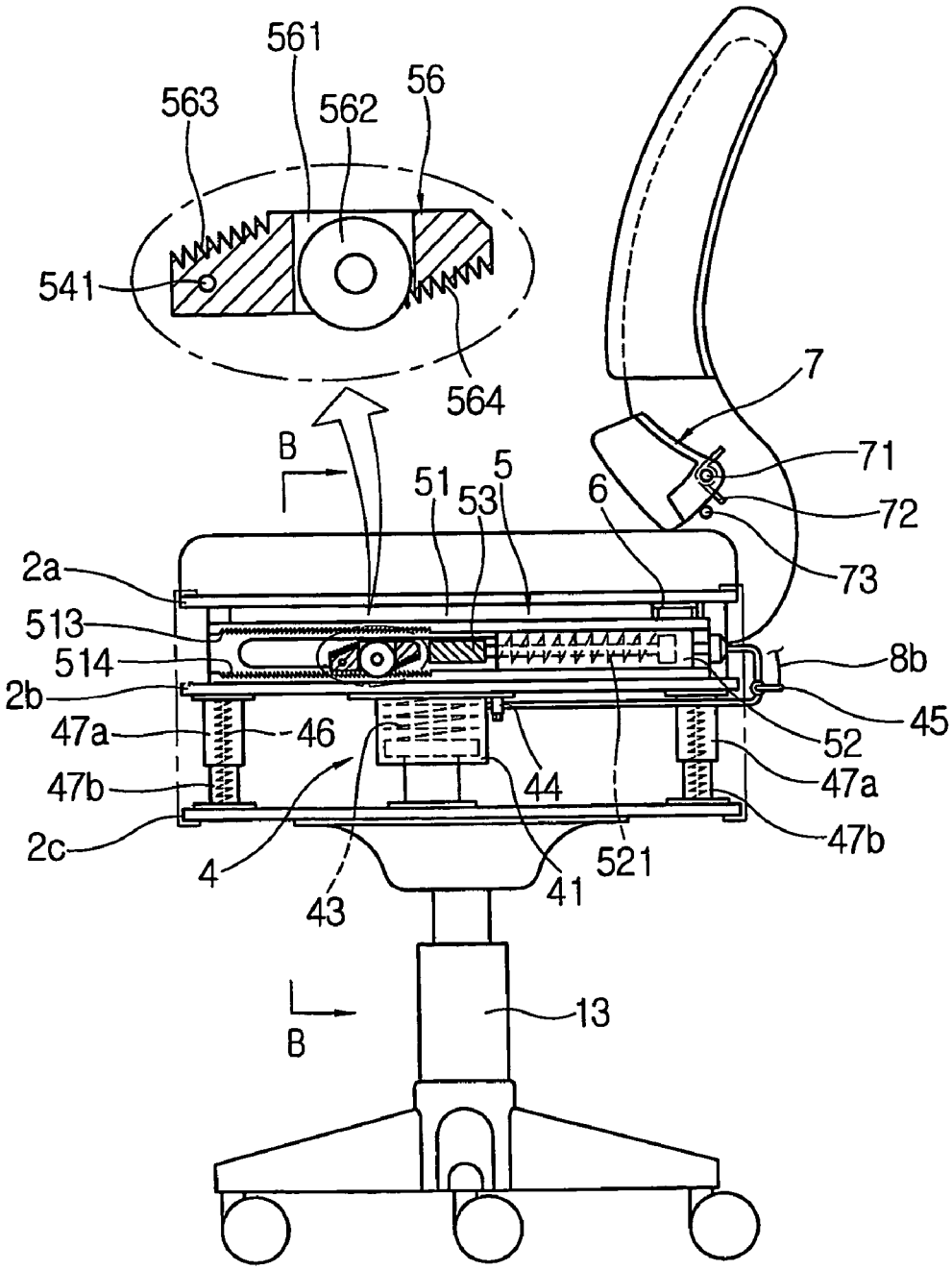

[Fig.4]
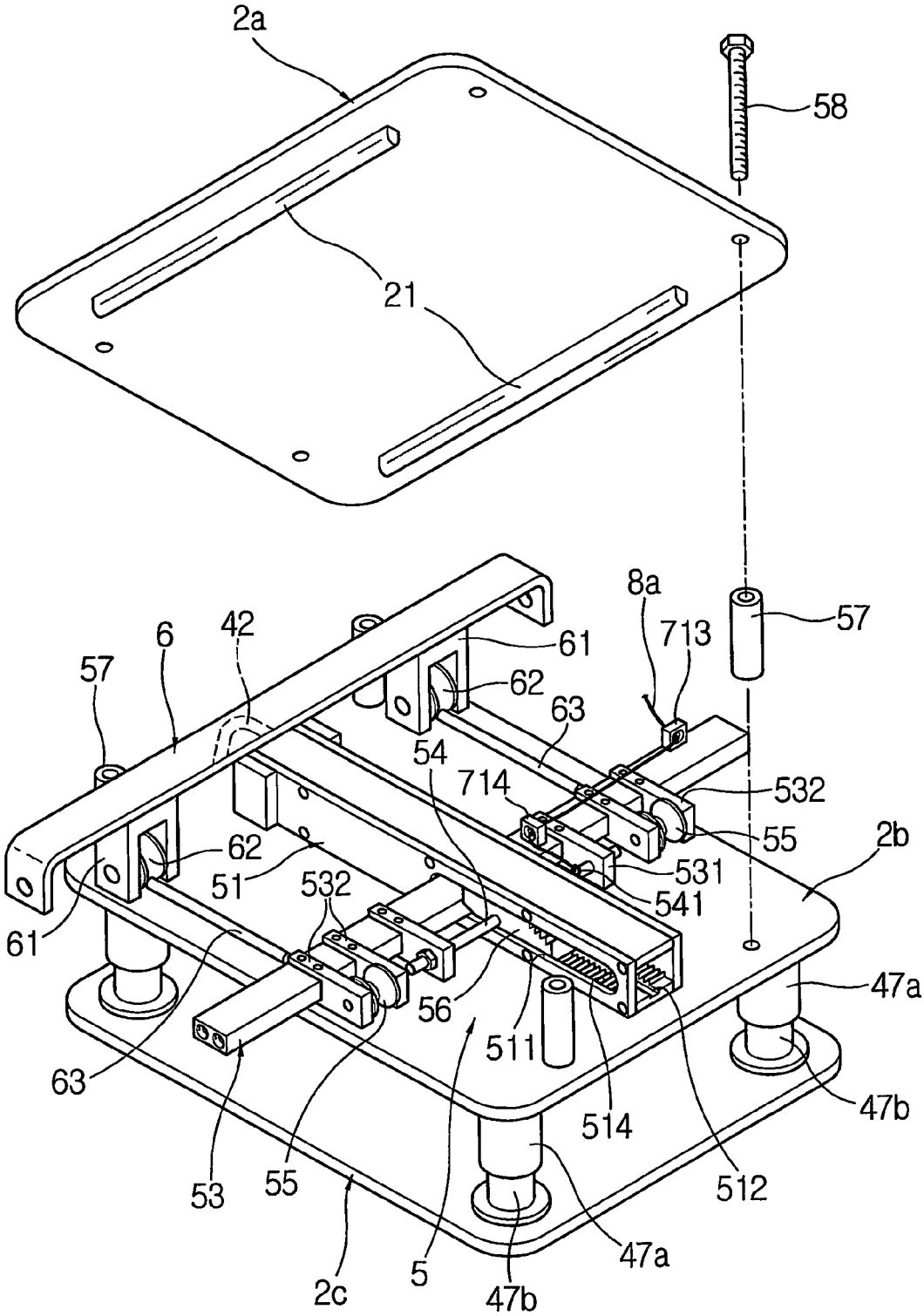

[Fig.5]
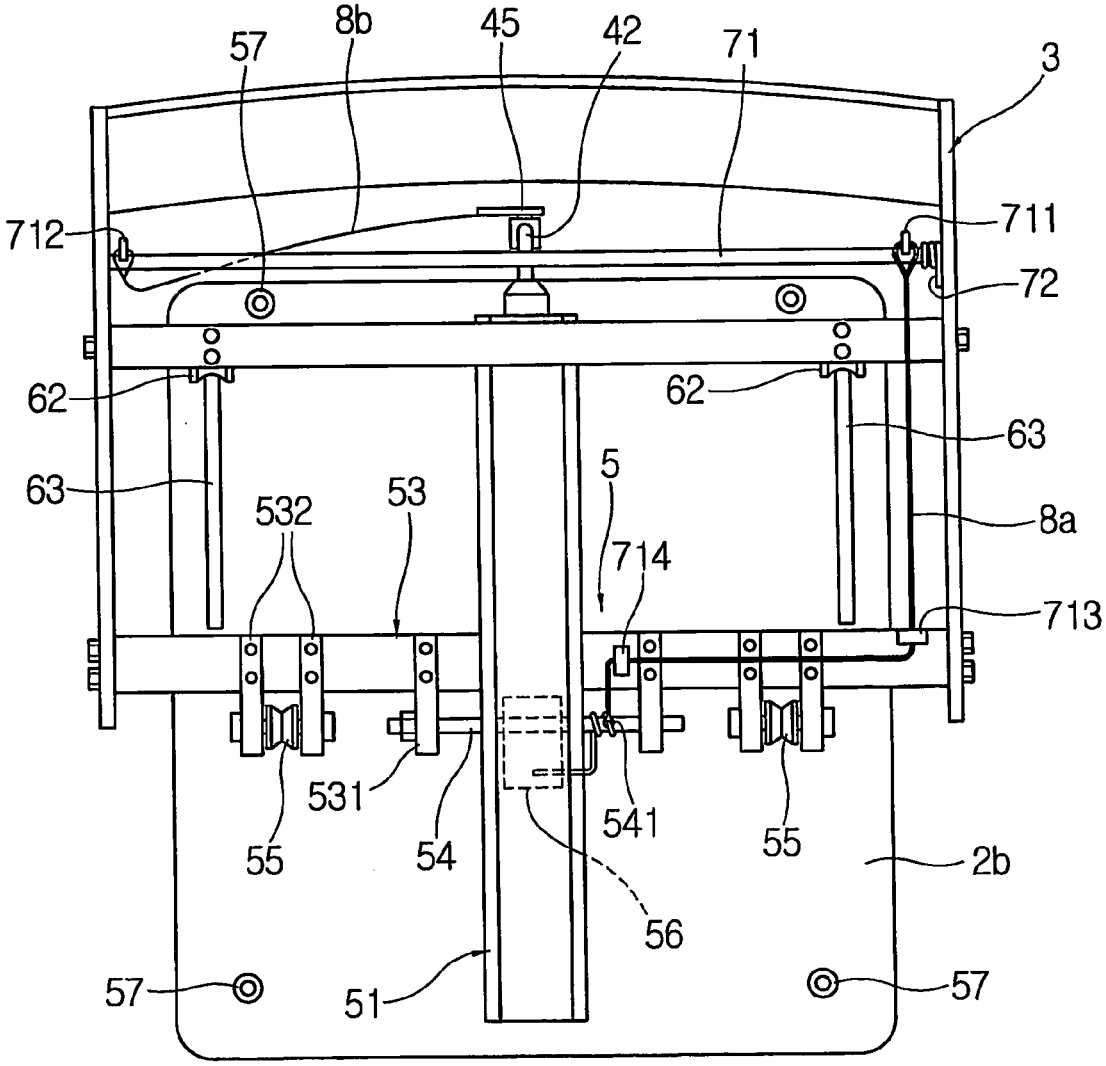

[Fig.6]
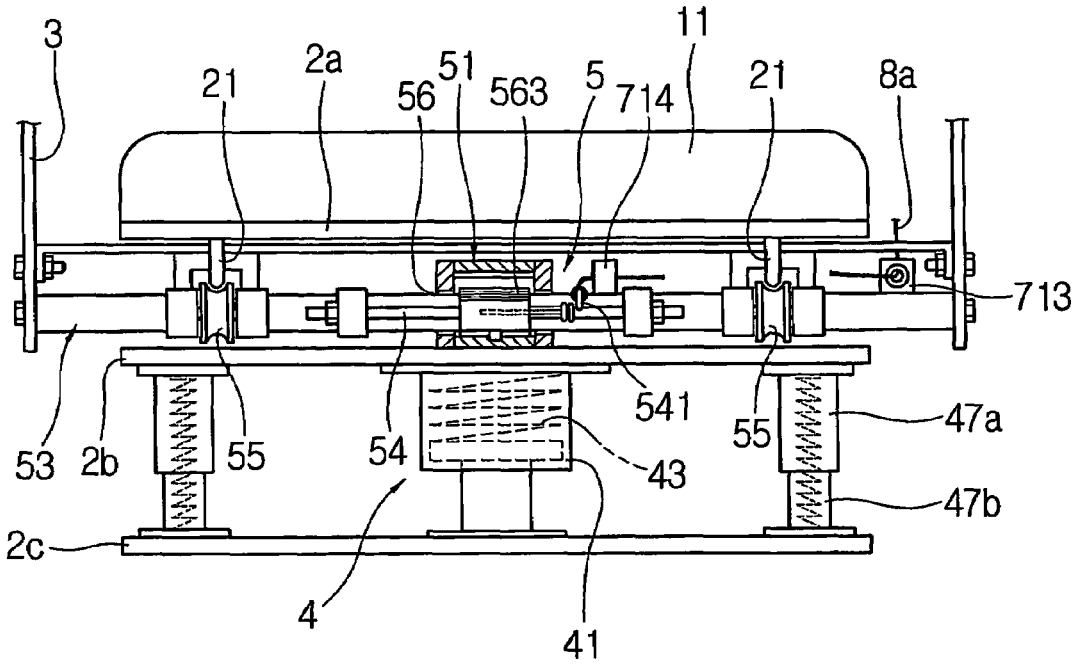

[Fig.7]
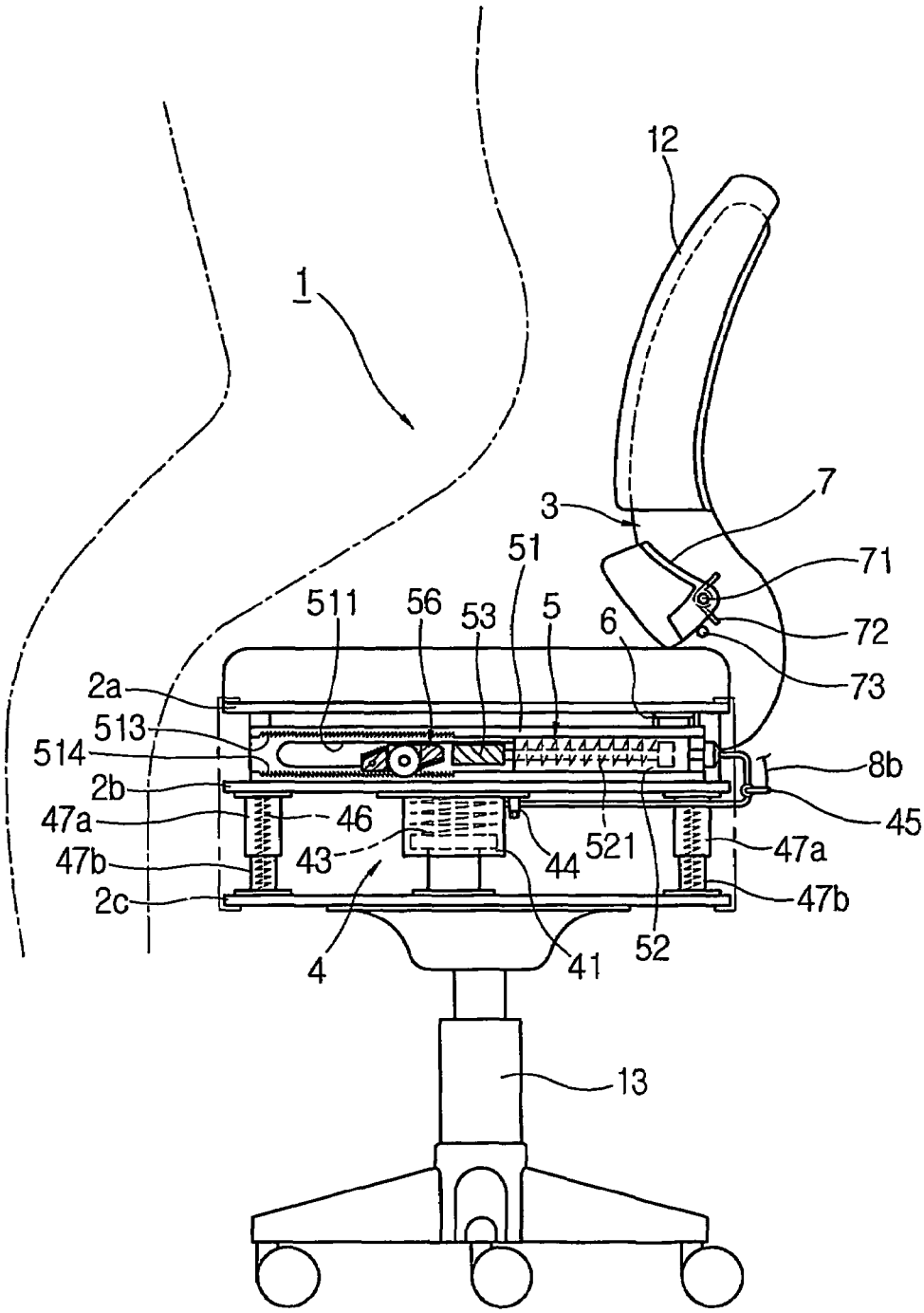

[Fig.8]
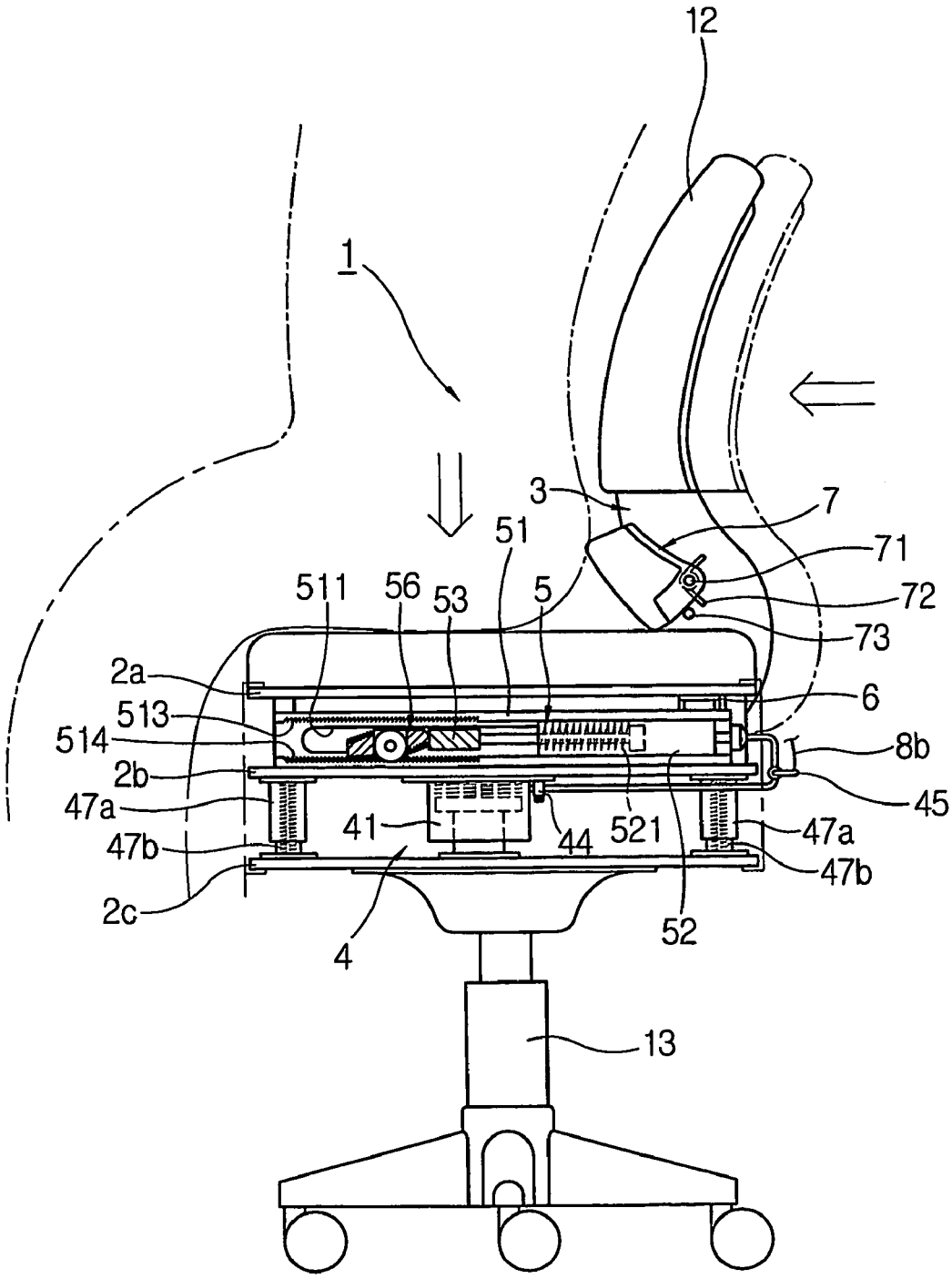

[Fig.9]
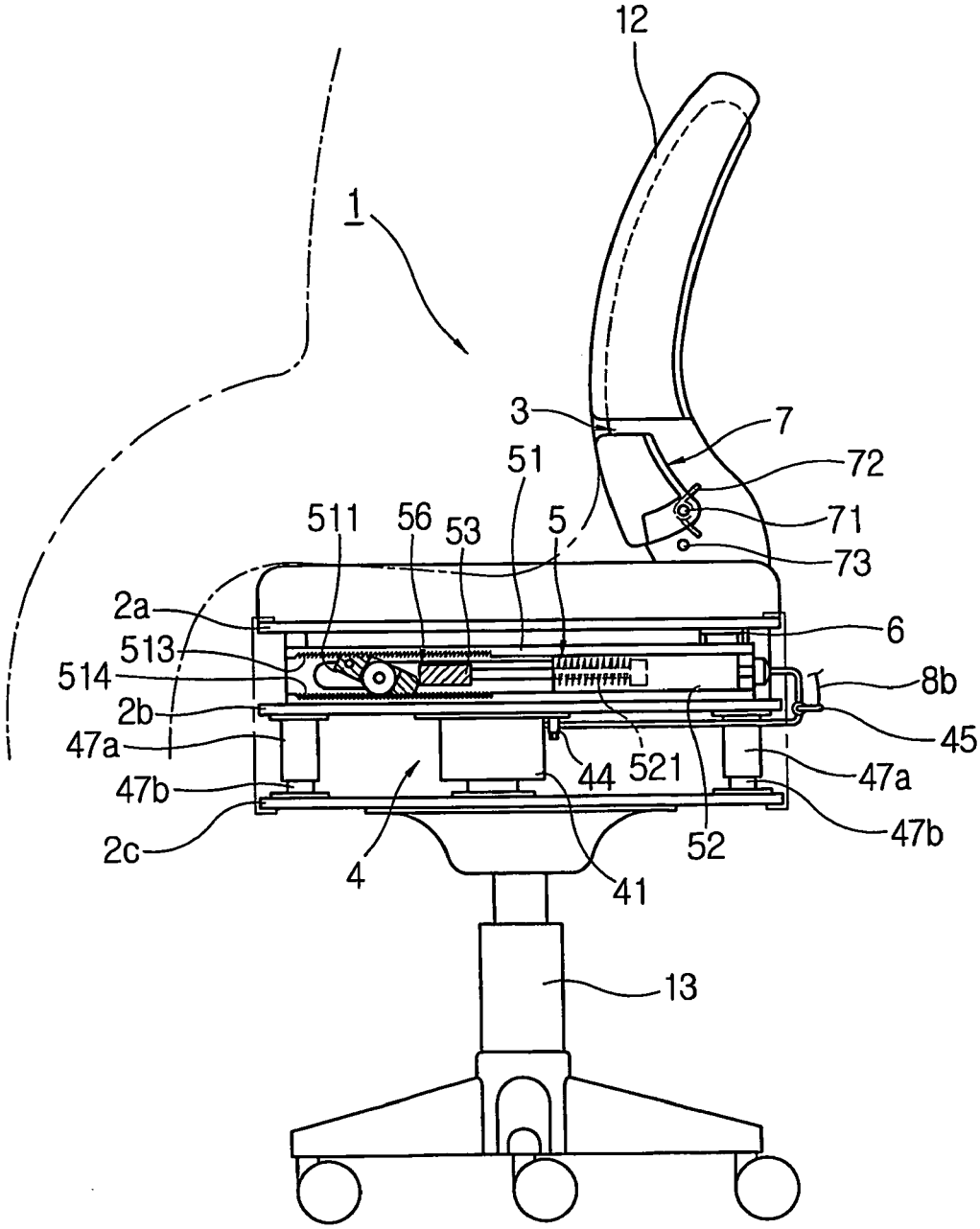

[Fig. 10]
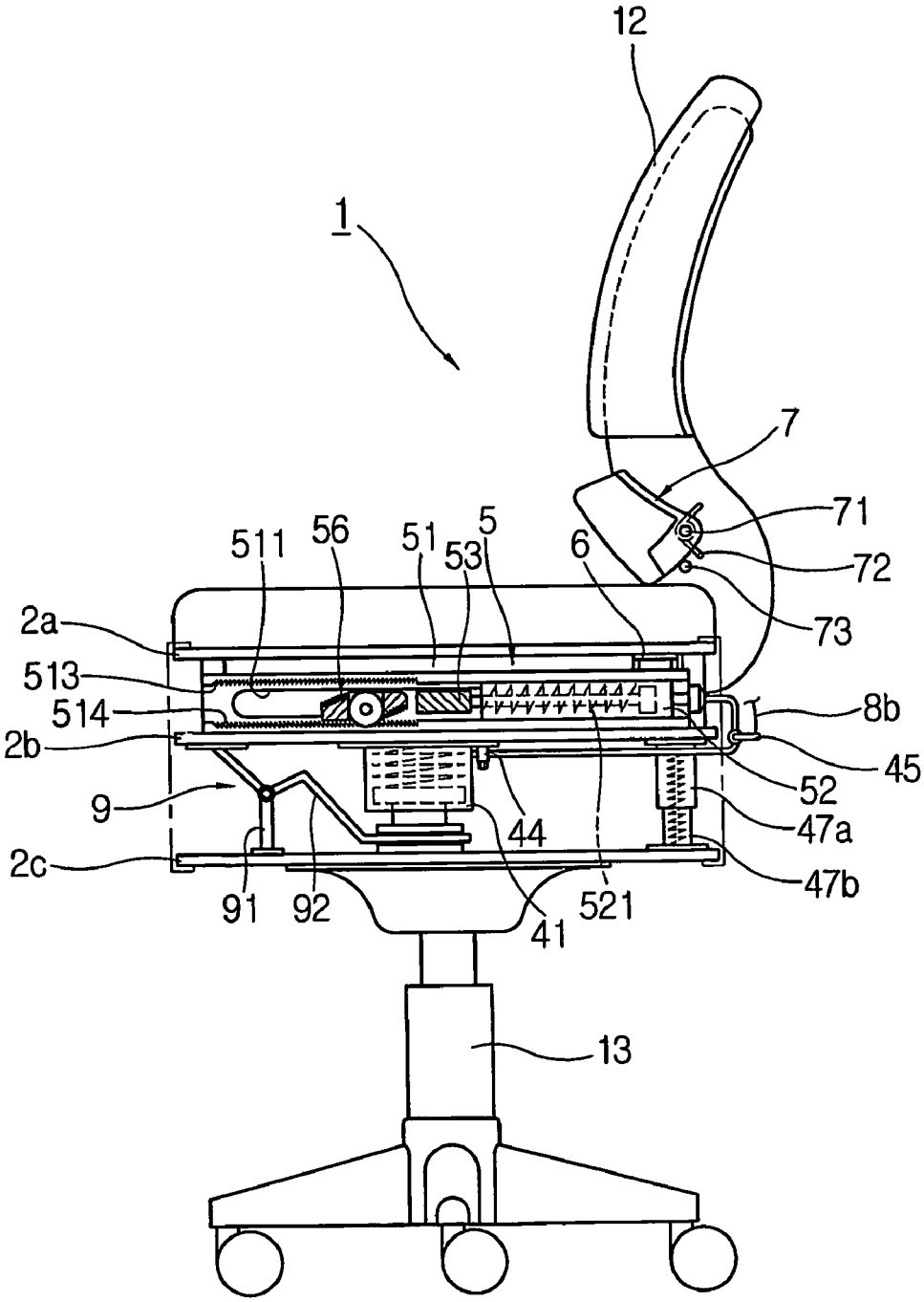

CHAIR HAVING AUTOMATICALLY ADJUSTABLE BACKREST

TECHNICAL FIELD

The present invention relates to a chair having an automatically adjustable backrest for thereby preventing various backbone-related diseases, and in particular to a chair having an automatically adjustable backrest for thereby preventing various backbone-related diseases in which a user's backbone is safely protected in such a manner that a chair backrest is automatically adjusted based on a user's weight, and a user's back is safely supported, so that a user can sit in an upright posture even when a user sits in a seat in a state that a user's back is not property supported by a backrest of a chair wherein a user uses various kinds of chairs including a seat that has four legs supported by the floor or that is adjustable in a forward or backward direction in a vehicle.

BACKGROUND ART

All people study or work for a business using a desk or a table in an office and conference room of a school, academy institute or public organs or various industrial fields, sitting on chair. In this case, almost chairs have backrests for safely supporting a user's back.

Generally, since a chair backrest supports a back of a user sitting on a chair, the user can take a rest in comfortable posture. In addition, the user's back can be protected in such a manner that a user's back is properly supported. When sitting on a chair, it is needed to sit on a chair in an upright posture in such a manner that a hip part of a user is closely contacted with a rear side of a seat, and a user's back is contacted with a backrest.

Therefore, the backrest of a chair is basically designed to safely protect a user's back based on a human body mechanic system.

The conventional chair has a structure that a backrest is elastically supported in a backward direction, and a dual-back structure that a backrest is divided into two parts for thereby effectively supporting both sides of a backbone of a user.

In the conventional chair, since a backrest of a chair is fixed at a set position irrespective of a position that a user sits, a user must move his hip to a deep corner of a seat in order to sit in upright posture and a user's back must be supported by a backrest, so that a user can sit on a chair in an upright posture. In the case that a user sits on a chair in a manner that a hip part of a user is positioned at an intermediate portion of a seat or is positioned at a front side of a seat, the backside of a user cannot be properly supported by a backrest of a chair. If the user works for a long time in a state that the user did not sit on a chair in an upright posture, a user's back may receive over load, so that a user may feel fatigue within a short time period. In addition, an abnormal phenomenon may occur in a backbone. Namely, the user may have a certain disease such as a back disc, etc.

A student studying on a chair or a worker working on a chair may sit at a rear side of a seat with his hip portion being positioned at a rear side of a sear, without sitting on a chair in an upright posture. If the user works in the above posture for a long time, since the user's upper body is not safely supported by a backrest of a chair, the user may feel fatigue faster. In more serious case, an over load may be applied to a user's back, so that a certain disease such as a back disc may occur in a user's back.

DISCLOSURE OF INVENTION

Accordingly, it is an object of the present invention to provide a chair having an automatically adjustable backrest for thereby preventing various backbone-related diseases capable of overcoming the problems encountered in a conventional art.

It is another object of the present invention to provide a chair having an automatically adjustable backrest for thereby preventing various backbone-related diseases in which a backrest of a chair is automatically adjusted to closely contact with a user's back so that a user sits on a chair in an upright posture for thereby protecting a user's back without an artificial operation even when a user sits on a chair in such a manner that a user's hip portion is positioned at an intermediate portion or a front side of a seat, not in a proper manner that a user's hip portion is closely contacted with a back side of a seat when sitting on a chair. In addition, in a state that a backrest of a chair is closely contacted with a user's back as a backrest is forwardly moved in the above manner, when a user adjusts his sitting posture to a forward direction, the backrest is automatically further moved in a forward direction. Even when a user tilts his back backwardly, sitting on a chair, the backrest is not backwardly moved for thereby safely supporting a user's back. Therefore, the user can always sit on a chair in an upright posture when sitting on a chair.

To achieve the above objects, in a chair having a seat, a backrest and support legs, there is provided a chair having an automatically adjustable backrest for thereby preventing various backbone-related diseases, comprising upper, intermediate and lower plates that are installed between the seat and the support legs at a certain interval therebetween in upper and lower directions; a hydraulic pressure-applying unit that is installed between the intermediate plate and the lower plate in such a manner that an elastic operation is achieved in the upper and lower directions, and includes a hydraulic pressure-applying cylinder operating in such a manner that when a user sits on a chair, the intermediate plate is elastically compressed by the weight of the user, and a hydraulic pressure is applied to a reciprocation operation cylinder installed between the upper plate and intermediate plate, and when the user gets up from the seat, the compressed state of the intermediate plate is recovered to its original state, so that the hydraulic pressure supplied to the cylinder is collected; a guide box that is installed between the upper plate and the intermediate plate and is horizontally installed on an upper surface of the intermediate plate in the forward and backward directions; a backrest moving unit including a reciprocation operation cylinder that is horizontally installed in the interior of the guide box, and the piston rod is appeared as the hydraulic pressure is inputted when the hydraulic pressure is discharged from the hydraulic pressure-applying cylinder of the hydraulic pressure-applying unit, and when the hydraulic pressure-applying cylinder collects the hydraulic pressure, the hydraulic pressure is discharged for thereby disappearing the piston rod; and a main operation member that is horizontally installed and passes through a movement elongated hole formed at both sides of the guide box in a direction perpendicular to the guide box and is connected with a front end of the piston rod of the reciprocation operation cylinder and is forwardly and backwardly moved within a moving range of the movement elongated hole of the guide box based on the forward and backward movements of the piston rod; a backrest frame that is connected with both ends of the main operation member of the backrest moving unit and is forwardly and backwardly moved together with the main operation member; and an assistant operation member that is movably installed at a rear side between the upper plate and the intermediate plate and is forwardly and backwardly moved together with the backrest frame in a state that both ends of the same are connected with the backrest frame.

In the hydraulic pressure-applying unit, a certain fluid selected between oil or gas is injected into the hydraulic pressure-applying cylinder, and the hydraulic pressure-applying cylinder is connected in such a manner that a hydraulic pressure is supplied to the reciprocation operation cylinder of the backrest moving unit through the hydraulic pressure line and is collected, and a hydraulic pressure control valve is connected with the hydraulic pressure line for controlling the flow of hydraulic pressure by opening and closing the pressure adjusting valve capable of adjusting the discharge amount of the hydraulic pressure and the hydraulic pressure line.

The backrest moving unit includes a shaft support member fixed to both sides near the movement elongated hole of left and right sides with respect to the guide box; an operation shaft that passes through the movement elongated hole of the guide box, wherein both ends of the same are rotatably installed at the shaft support member through the movement elongated hole of the guide box; a stopper that is installed in the interior of the guide box in a state that it is fixed to the operation shaft; a pair of roller support members fixed to both sides of the main operation member; and a guide roller that is rotatably installed at the roller support member and supports a protruded guide rail at both lower sides of the upper plate in parallel and rolls along the guide rail as the main operation member is moved.

In the stopper of the backrest moving unit, a moving roller is rotatably installed in the operation shaft in a roller installation hole and forwardly and backwardly moves along a moving path formed at a lower center portion of the guide box, and backward and forward movement prevention driving gears are installed at an upper surface of the forward side of the stopper, and at a lower surface of the backward side of the same in a slanted state for thereby stopping the stopper.

The backward and forward movement prevention fixing gears engaged with the backward and forward movement prevention driving gears formed in the stopper are formed in the upper and lower surface of the inner side of the guide box for thereby stopping the stopper.

A rotary shaft is installed at a portion higher than the seat as a lower side of the backrest frame wherein both ends of the same are rotatable with respect to the backrest frame; and a detection lower backrest is provided separately from the backrest in the rotary shaft that is rotated in a state that it is protruded in the direction of the seat in the case that the user is not sited on the chair or a certain space is formed between the user's hip portion and the backrest, and when the user sits on the chair, the backrest frame is moved in the forward direction, so that the backrest first contacts with the user's hip portion before the backrest contacts with the back portion of the user for thereby being rotated as if it is pushed in the backward direction, thus rotating the rotary shaft; and a stopper operation wire connects an end of one side of the rotary shaft and one end of the operation shaft of the main operation member and transfers a rotational force when the rotary shaft is rotated, so that the stopper performs a movement prevention operation and movement release operation.

A rotary shaft is installed at a portion higher than the seat as a lower side of the backrest frame wherein both ends of the same are rotatable with respect to the backrest frame; and a detection lower backrest is provided separately from the backrest in the rotary shaft that is rotated in a state that it is protruded in the direction of the seat in the case that the user is not sited on the chair or a certain space is formed between the user's hip portion and the backrest, and when the user sits on the chair, the backrest frame is moved in the forward direction, so that the backrest first contacts with the user's hip portion before the backrest contacts with the back portion of the user for thereby being rotated as if it is pushed in the backward direction, thus rotating the rotary shaft; and a hydraulic pressure control wire connects an end of one side of the rotary shaft and a hydraulic pressure control valve installed in the hydraulic pressure line for thereby opening and closing the hydraulic, pressure control valve.

BRIEF DESCRIPTION OF DRAWINGS

The present invention will become better understood with reference to the accompanying drawings which are given only by way of illustration and thus are not limitative of the present invention, wherein;

FIGS. 1 and 2 are views illustrating a front and lateral side of a chair according to the present invention;

FIG. 3 is a cross sectional view taken along line A-A of FIG. 1;

FIG. 4 is a partially separated perspective view illustrating a major part for describing the present invention;

FIG. 5 is a plane view illustrating an arrangement state of elements provided in an intermediate plate frame by separating a seat and an upper plate frame and a connection state with a backrest frame for describing the present invention;

FIG. 6 is a cross sectional view taken along line B-B of FIG. 3;

FIGS. 7 through 9 are cross sectional views of an operation state of a backrest according to the present invention, of which:

FIG. 7 is a view illustrating a state before a user sits on a chair;

FIG. 8 is a view illustrating a state that a backrest frame is moved when a user sits on a chair; and FIG. 9 is a view illustrating an operation state of a lower backrest for a control when a backrest framer is moved; and FIG. 10 is a cross sectional view illustrating a chair according to another embodiment of the present invention.

BEST MODE FOR CARRYING OUT THE INVENTION

The preferred embodiment of the present invention will be described with reference to the accompanying drawings.

FIGS. 1 and 2 are views illustrating a front and lateral side of a chair according to the present invention; FIG. 3 is a cross sectional view taken along line A-A of FIG. 1; FIG. 4 is a partially separated perspective view illustrating a major part for describing the present invention; FIG. 5 is a plane view illustrating an arrangement state of elements provided in an intermediate plate frame by separating a seat and an upper plate frame and a connection state with a backrest frame for describing the present invention; FIG. 6 is a cross sectional view taken along line B-B of FIG. 3; FIGS. 7 through 9 are cross sectional views of an operation state of a backrest according to the present invention, of which FIG. 7 is a view illustrating a state before a user sits on a chair; FIG. 8 is a view illustrating a state that a backrest frame is moved when a user sits on a chair; and FIG. 9 is a view illustrating an operation state of a lower backrest for a control when a backrest framer is moved; and FIG. 10 is a cross sectional view illustrating a chair according to another embodiment of the present invention.

In the drawing, reference numeral 1 represents a chair. The chair 1 includes a seat 11 on which a user sits, a backrest 12 for supporting a user's back, and support legs 13 for supporting the seat. The support legs 13 include a height-adjusting cylinder and wheels supported by the floor. As shown in FIG. 2, an armrest is provided at both sides of the seat 11.

The seat 11 of the chair 1 is designed in order for the user to comfortably sit thereon like a conventional chair. The support legs 13 are capable of adjusting the height of the chair line a conventional chair and have wheels by which the chair is movable in a state that a user sits on the chair.

In the present invention, there is provided a backrest frame 3 between the seat 11 and the support legs 13. A backrest 12 is attached to a backrest frame 3 using an upper plate 2*a*, an intermediate plate 2*b* and a lower plate 2*c* that are installed at a certain interval in the upper and lower directions. Even when a user sits on a chair in a state that his hip portion is not closely contacted with a backrest, the backrest 12 is automatically forwardly moved until it contacts with a user's back without an additional operation. In addition, in the case that the user tilts his upper body without moving his hip portion in a state that the user sits on a chair without an additional operation, the backrest 12 is not moved. When the user gets up from the seat 11, the backrest 12 is automatically backwardly moved and is returned to its original position.

The constructions of each element for implementing the above operation will be described.

A hydraulic pressure-applying unit 4 is installed between the intermediate plate 2*b* and the lower plate 2*c*. Here, in the hydraulic pressure-applying unit 4, a cylinder body is attached to a lower side of the intermediate pate 2*b*, and a front end of a piston rod is formed of a hydraulic pressure-applying cylinder 41 attached to an upper surface of the lower plate 2*c*. The hydraulic pressure-applying cylinder outputs a hydraulic pressure through a hydraulic pressure line 42 based on a weight of a user (more than 15 kg) and performs a compression operation when the user sits on the seat 11 as a hydraulic pressure is filled thereinto. In addition, when the user gets up from the seat 11 and the weight applied to the hydraulic pressure-applying cylinder is removed, the hydraulic pressure discharged during the compression is sucked, and it is returned to its original state. The fluid filled in the hydraulic pressure-applying cylinder 41 may be selected between oil or gas or a combination of oil and gas.

In addition, a return spring 43 is elastically installed in the interior of the cylinder body for thereby achieving a faster compression and returning operation of the hydraulic pressure-applying cylinder 41. The hydraulic pressure line 42 is provided to transfer the hydraulic pressure discharged when the hydraulic pressure-applying cylinder 41 performs a compression operation to a reciprocation cylinder 52 of a transfer unit 5. A hydraulic pressure control valve 45 is installed in the hydraulic pressure line 42 for controlling the flow of hydraulic pressure by opening and closing the pressure adjusting valve 44 and the hydraulic pressure line 42.

The hydraulic pressure control valve 45 is basically provided to open and close the hydraulic pressure line 42. It may have a mechanical structure like a ball valve or an electrical structure such as a solenoid valve.

In addition, the intermediate plate 2*b* and the lower plate 2*c* are supported by upper and lower support pipes 47*a* and 47*b* having a spring 46 therein. Here, the upper end of the upper support pipe 47*a* is attached to a lower side of the intermediate plate 2*b*, and the lower side of the same surrounds the lower support pipe 47*b* attached to an upper surface of the lower plate 2*c*. It is elastically operated in the upper and lower directions by the spring 46. The upper and lower support pipes 47*a* and 47*b* elastically support the intermediate plate 2*b* together with the hydraulic pressure-applying cylinder 41.

A backrest-moving unit 5 is installed between the upper plate 2*a* and the intermediate plate 2*b*.

The backrest-moving unit 5 includes a guide box 51 fixed in a straight line shape in the forward and backward directions from the center of the intermediate plate 2*b*, a reciprocation cylinder 52 that is installed in an inner side of the guide box for reciprocating a piston rod (forward and backward movements), and a main operation member 53 that is horizontally formed in such a manner that a movement elongated hole 511 formed in the forward direction from the left and right intermediate portions of the guide box 51 passes through therein, wherein it is connected with a front end of the piston rod of the reciprocation cylinder and reciprocates within a set range of the movement elongated hole 511.

In addition, a shaft support member 531 is installed near the movement elongated hole 511 with respect to the guide box 51, respectively, in the main operation member 53. A pair of roller support members 532 are fixed at a portion distanced from the movement elongated hole 511 of both sides. The both ends of the operation shaft 54 are connected with the shaft support member 531 by nuts wherein the operation shaft 54 is horizontally installed and passes through the movement elongated hole 511. A guide roller 55 is rotatably installed in the roller support members 532 provided in pair. The guide rollers 55 of both sides are moved along a guide rail 21 protruded from the lower side of the upper plate 2*a* in parallel.

A stopper 56 is installed at an intermediate portion of the operation shaft 54 positioned in the interior of the guide box 51 and rotates together with the operation shaft 54. A movement roller 562 rotatably installed in the operation shaft 54 is installed in a roller installation hole 561 passing through the stopper 56. The movement roller is forwardly and backwardly movable along a movement path 512 formed in the lower surface of the guide box 51 in the forward direction in a shape of groove.

In addition, a tooth-shaped fixing gear 513 for a backward movement prevention control and a tooth-shaped fixing gear 514 for a forward movement prevention control are formed on the upper and lower surfaces of the guide box 51. A driving gear 563 for a backward movement prevention control and a driving gear 564 for a forward movement prevention control are provided on the forward upper surface and backward lower surface of the stopper 56 and are engaged and disengaged with the fixing gear 513 for the backward movement prevention control and the fixing gear 514 for the forward movement prevention control. Here, the fixing gear and the driving gear are disengaged for thereby permitting the forward and backward movements of the stopper when the stopper 56 stops and moves in the horizontal state. When the stopper 56 is rotated in the clockwise direction, the driving gears formed in the forward upper surface and backward lower surface are engaged with the fixing gears formed on the upper and lower surfaces of the guide box 51. When the driving gear of the stopper 56 is engaged with the fixing gear of the guide box, the stopper 56 cannot move forwardly and backwardly, namely, it is fixed. Therefore, the main operation member 53 having the operation shaft 54 that supports the stopper 56 cannot move forwardly and backwardly. When the stopper 56 and the main operation member 53 are stopped, the movement unit 5 is stopped.

A return spring 521 is elastically installed in the interior of the reciprocation cylinder 52 for returning the piston to its original position.

In addition, an assistant operation member 6 that is moved together with the main operation member is installed in the rear side of the main operation member 53.

Here, the assistant operation member is installed in parallel with the main operation member 53 at the height slightly higher than the height of the guide box 51 in the rear side of the intermediate plate 2*b*. The support roller 62 rotatably attached to a bracket 61 fixed to both sides of the lower portion of the assistant operation member 6 rolls in the forward and backward directions in a state that it is supported by the support rail 63 fixed to the rear upper surface of the intermediate plate 2*b*.

The upper plate 2*a* and the intermediate plate 2*b* are engaged in a state that the upper and lower portions are fixed. A plurality of cylindrical spacers 57 are installed between the upper plate 2*a* and the intermediate plate 2*b*. Here, the upper plate and the intermediate plate are fixedly engaged by engaging an engaging bolt 58 passing through the center of the space 57 using a nut. In addition, a support member is installed on an upper surface of the guide box 51 installed on the upper surface of the intermediate plate 2*b* for supporting the intermediate portion of the upper plate 2*a*. Therefore, it is possible to prevent the upper plate 2*a* from being sunk by the weight of the user.

The backrest frame 3 will be described.

The upper side of the backrest frame 3 is upwardly protruded for thereby supporting the back portions of the user sitting on the chair. The lower side of the same is extended in the left and right sides of the chair 1 and is concurrently connected with both sides of the main operation member 53 and the assistant operation member 6 using an assembling member such as bolt, etc.

Therefore, as the main operation member 53 of the movement unit 5 is forwardly and backwardly moved, the backrest frame 3 is moved together, and the assistant operation member 6 is moved when the backrest frame 3 is moved.

A detection lower backrest 7 is installed just below the backrest 12 formed in the backrest frame 3. It is installed at the portion slightly higher than the upper surface of the rear side of the seat 11 and is installed in a rotary shaft rotatably and horizontally installed in a lower side of the backrest frame 3. The detection lower backrest 7 is rotatable together with the rotary shaft 71.

When the user does not use the chair, the detection lower backrest 7 maintains slanted forwardly. Namely, the rotary shaft 71 passes through the rear end of the lower side of the detection lower backrest 7 in a state that the detection lower backrest 7 is more forwardly protruded as compared to the backrest 12 (namely, in a state that the rotation operation is ready in the rear direction as the detection lower backrest contacts with the hip portion of the user when the backrest frame of forwardly moved when the user sits on the chair). Therefore, when the user does not sit on the chair, the detection lower backrest 7 is forwardly rotated by the self-weight with respect to the rotary shaft 71 as a rotation center and maintains a slanted state in such a manner that the upper side of the detection lower backrest 7 is protruded in the forward direction.

A torsion spring 72 is installed at one end or both ends of the rotary shaft 71 for assisting an operation that the detection lower backrest 7 is tilted in the forward direction when the user sits and gets up from the chair.

In addition, one end of the rotary shaft 71 and one end of the operation sensor 541 installed in the operation shaft 51 of the backrest moving unit 5 are connected by a stopper operation member 8*a*. In a state that the operation wire 541 is rotatably wound on one side of the operation shaft 54, one end of the same is connected with a stopper operation wire 8*a*, and the other end of the same is inserted into a hole formed in a front end of the stopper 56. Therefore, when the stopper operation wire 8*a* pulls one end of the operation wire 8*a*, the other end of the same rotates the stopper 56 in the clockwise direction. In addition, the other end of the rotary shaft 71 and the hydraulic pressure control valve 45 of the hydraulic pressure generation unit 4 are connected by the hydraulic pressure control wire 8*b*.

The stopper operation wire 8*a* and the hydraulic pressure control wire 8*b* are formed of a wire cable that is easily bent and is not twisted for thereby well transferring a pulling force. One end of the stopper operation wire 8*a* is connected with a first protrusion 711 protruded from one end of the rotary shaft 71, and the other end of the same is connected with one end of the operation wire 541 rotatably wound on the operation shaft 54. One end of the hydraulic pressure control wire 8*b* is connected with a second protrusion 712 formed at the other end of the rotary shaft 71, and the other end of the same is connected with an opening and closing member of the hydraulic pressure control valve 45.

The hydraulic pressure control valve 45 may be formed of any type of valve capable of connecting or disconnecting the supply of the hydraulic pressure from the hydraulic pressure-applying cylinder 41 to the reciprocation operation cylinder 52.

In the case of the stopper operation wire 8*a*, the rotary shaft 71 and the operation wire 541 are connected in such a manner that the stopper operation wire 8*a* is extended from one end of the rotary shaft 71 installed in the backrest frame 3 through the guide hole formed in two guide members 713 and 714 attached to the upper surface of one side of the main operation member 53 of the backrest moving unit 5 and is bent in a certain direction. In addition, the hydraulic pressure control wire 8*b* is extended and bent between the end of the rotary shaft 71 and the opening and closing member of the hydraulic pressure control valve 45 for thereby connecting the rotary shaft 71 and the opening and closing member of the hydraulic pressure control valve 45.

Here, the operation member 541 is formed of a metallic wire and is rotatable with respect to the operation shaft 54.

When the rotary shaft 71 is rotated, the operation wire 541 and the hydraulic pressure control valve 45 are rotated. Namely, as the detection lower backrest 7 is rotatably moved in the rear direction, when the rotary shaft 71 is rotated in the clockwise direction, as shown in FIG. 9, in the case of the stopper operation wire 8*a*, the operation wire 541 of the backrest moving unit 5 rotates the stopper 56 in the clockwise direction, so that the backward and forward movement prevention driving gears 563 and 564 of the stopper m56 are engaged with the backward and forward movement prevention fixing gears 513 and 514. In the case of the hydraulic pressure control wire 8*b*, it opens and closes the opening and closing member of the hydraulic pressure control valve 45.

In addition, the upper plate 2*a*, intermediate plate 2*b* and lower plate 2*c* supporting the seat 11 of the chair 1 are covered with a protection casing in all directions. The protection casing allows the upper plate and intermediate plate to move upwardly and downwardly and supports the upper and lower plates. As the user sits on the chair or gets up from the same, even when the upper plate and intermediate plate are elastically compressed or recovered, the protection casing always maintains a state of covering the upper, intermediate and lower plates.

The operation that the backrest is automatically adjusted as the user uses the chair will be described.

FIGS. 3 and 7 are cross sectional views when the chair 1 is not used. The detection lower backrest 7 installed below the backrest 12 is rotated in a state that it is tilted in the forward direction with respect to the rotation shaft 71 by the self weight, and the upper end of the same is more protruded in the forward direction as compared with the backrest 12. In addition, the lower side of the same does not contact with the seat 11 with a certain distance. A rotation control shaft 73 is installed in a lower side of the backrest frame 3 for controlling an angle that the detection lower backrest 7 is rotated in the forward direction. Therefore, the detection lower backrest 7 is moved without contacting with the seat 11 when the backrest frame 3 is forwardly or backwardly moved.

FIG. 8 is a cross sectional view of an operation state when a user uses a chair according to the present invention. The user generally, sits on a chair with his hip portion being positioned at an intermediate portion of the seat 11, not positioned at a rear end of the seat. When the user sits on the seat in the above manner, the weight of the user is applied to the seat 11. At this time, since the upper plate 2*a* and the intermediate plate 2*b* are fixed by the spacer 57 and the engaging bolt 58, even when the user sits on the seat 11, the distance between the upper plate 2*a* and the intermediate plate 2*b* is not changed. Namely, since the intermediate plate 2*b* is supported by the hydraulic. pressure-applying cylinder 41 and the upper and lower support pipes 47*a* and 47*b* that may be elastically compressed with respect to the lower plate 2*c*, the hydraulic pressure-applying cylinder 41 and the upper support pipes 47*a* that support the intermediate plate 2*b* are elastically compressed by the weight of the user sitting on the seat 11. When the hydraulic pressure-applying cylinder 41 of the hydraulic pressure-applying unit 4 is elastically compressed, the hydraulic pressure filled therein is discharged through the hydraulic pressure line 42 and is supplied to the reciprocation operation cylinder 52 of the backrest moving unit 5. The hydraulic pressure supplied to the reciprocation operation cylinder 52 is higher than the elastic force of the return spring 521 elastically supporting the piston head, so that the piston rod of the reciprocation operation cylinder 52 is forwardly moved in the forward direction of the chair, whereby the main operation member 53 is forwardly moved. As the main operation member 53 is forwardly moved, the stopper 56 movably installed in the interior of the guide box 51 is moved in the forward direction.

When the main operation member 53 of the backrest moving unit 5 is moved in the forward direction, the backrest frame 3 is moved. At this time, the backrest 12 and the detection lower backrest 7 are forwardly moved in the direction of the user's back sitting on the seat 11. Since the detection lower backrest 7 is protruded in a forwardly tilted state, when the backrest frame 3 is forwardly moved, the detection lower backrest 7 first contacts with the user's hip before the backrest 12 contacts with the user's back. The backrest frame 3 continuously forwardly moved from when the protruded portion of the detection lower backrest 7 contacts with the user's hip portion to when the rotation in the backward direction is stopped. When the backrest 12 contacts with the user's back and cannot move anymore, the detection lower backrest 7 completes the rotation in the backward direction (clockwise direction). At the same time, the rotary shaft 71 is rotated in the same direction of the detection lower backrest 7.

When the rotary shaft 71 is rotated, the stopper operation wire 8*a* and the hydraulic pressure control wire 8*b* connected with both ends of the same are operated for thereby stopping the backrest frame 3. The above operation will be described in more detail with reference to FIG. 9.

As shown in FIG. 9, the backrest 12 is forwardly moved until it contacts with the back of the user sifting on the seat, and its forward movement is stopped. The detection lower backrest 7 is rotated in the backward direction with respect to the rotary shaft 71. When the detection lower backrest 7 is rotated in the backward direction, the rotary shaft 71 is rotated. Therefore, the first protrusion 711 formed at one end of the rotary shaft 71 pulls the stopper operation wire 8*a*, and the operation wire 541 installed in the operation shaft 54 of the backrest moving unit 5 is rotated in the clockwise direction, and the stopper 56 is rotated in the same direction. The backward movement and forward movement driving gears 563 provided in the upper surface of the forward side and lower surface of the backward side of the stopper are engaged with the backward and forward movement prevention fixing gears 513 and 514 formed on the upper and lower surfaces of the guide box 51. When the forward and backward driving gears of the stopper 56 are engaged with the upper and lower side fixing gears of the guide box 51, the backrest frame 3 is not moved in the forward and backward directions. At this time, the backrest 12 is supported by the user's back. The detection lower backrest 7 is fully rotated in the backward direction, and the backrest 12 is contacted with the user's back, and the detection lower backrest 7 is closely contacted with the user's hip portion. Therefore, the user can sit on the chair 1 in a leaned state to the backrest 12.

The first protrusion 711 of one end of the rotary shaft 71 pulls the stopper operation wire 8*a*, and the second protrusion 712 of the other end of the rotary shaft 71 pulls the hydraulic pressure control wire 8*b*. The hydraulic pressure control wire 8*b* changes the opened state to the closed state of the hydraulic pressure control valve 45 by a pulling operation of the second protrusion 712. When the hydraulic pressure control valve 45 is changed to the closed state, and the hydraulic pressure line 42 is closed, the supply and collecting operations of the hydraulic pressure to the hydraulic pressure-applying cylinder 41 and the reciprocation operation cylinder 52 are stopped. At this time, since the hydraulic pressure supplied to the reciprocation operation cylinder 52 is not moved in the direction of the hydraulic pressure-applying cylinder 41, the main operation member 53 is forwardly moved by a certain distance and then stops.

As the hydraulic pressure control wire 8*b* closes the hydraulic pressure control valve 45, the main operation member 53 of the backrest moving unit 5 is forwardly moved and stops. Therefore, the backrest frame 3 stops in a state that the backrest 12 is closely contacted with the back of the user sitting on the seat 11.

In the above structure, two stopper operation wire 8*a* and hydraulic pressure control wire 8*b* are connected with both ends of the rotary shaft 71 of the detection lower backrest 7. The stopper 56 and the hydraulic pressure control valve 45 are concurrently operated, so that the backrest 12 stops in a state that it is closely contacted with the user's back. Even when one of two wires 8*a* and 8*b* is selected and installed in the rotary shaft 71, the backrest 12 is closely contacted with the back of the user sitting in the seat 11 and is stopped. Therefore, the user can sit on the chair in a state that the user's back is leaned to the backrest 12.

When the user sits in the above manner, the backrest 12 is moved and stops in a state that it is closely contacted with the user's back In the above state, the user sits on the chair in an upright posture. Even when the user backwardly tilts his upper body in a state that he leaned to the backrest 12, sitting on the chair in an upright posture, the backrest frame 3 is not backwardly moved. Therefore, the user can safely lean to the backrest 12. Even when the user tilts his upper body forwardly without moving his hip portion, the backrest frame 3 is not forwardly moved. In the above state, when the user tilts his upper body in a state that he sits on a chair in an upright posture and returns to the original position, the user can lean to the backrest 12 in an upright posture.

When the user gets up from the seat 11 of the chair 1, the weight of the user applied to the seat 11 disappears, and at the same time the force applied to support the detection lower backrest 7 is removed, so that the backrest 12 is returned to the original state, namely, the non-use state. The above operation will be described in detail. First, the detection lower backrest 7 is rotated in the forward direction (counterclockwise direction) with respect to the rotary shaft 71 based on the elastic recovery force and self-weight of the torsion spring 72. When the detection lower backrest 7 is rotated in the forward direction (refer to FIG. 3), the rotary shaft 71 is rotated together. Therefore, the stopper operation wire 8*a* and the hydraulic pressure control wire 8*b* connected with both ends of the rotary shaft 71 operate the operation wire 541 and the hydraulic pressure control valve 45 in the manner reverse to the earlier described manner. Namely, the stopper operation wire 8*a* rotates the operation wire 541 in the counterclockwise direction, and the driving gears 563 and 564 of the stopper 56 are released from the upper and lower side fixing gears 513 and 514 of the guide box 51. The hydraulic pressure control wire 8*b* changes the closed state to the opened state of the hydraulic control valve 45. The hydraulic pressure line 42 connecting the hydraulic pressure-applying cylinder 41 and the reciprocation operation cylinder 52 is opened, and the hydraulic pressure supplied to the reciprocation operation cylinder 52 is collected by the hydraulic pressure-applying cylinder 41.

When the user gets up from the chair, in the hydraulic pressure-applying cylinder 41 elastically compressed by the weight of the user and the upper support pipes 47*a*, the intermediate plate 2*b* and the upper plate 2*a* are fast returned to the original state by the elastic recovery force of the spring. At this time, a certain suction force is generated in the interior of the hydraulic pressure-applying cylinder returned to the original state the elastic recovering force of the return spring 43 elastically compressed in the interior of the hydraulic pressure-applying cylinder 41 for thereby sucking the hydraulic pressure supplied to the reciprocation operation cylinder 52 through the hydraulic pressure line 42. In addition, the piston rod is moved into the interior of the cylinder by the elastic recovering force of the return spring 43 elastically compressed in the interior of the reciprocation operation cylinder 52 for thereby pushing the hydraulic pressure, so that the main operation member 53 is moved in the backward direction of the chair. Therefore, the backrest frame 3 is backwardly moved, and the backrest 12 is fully moved in the backward direction of the seat 11 and standbys for the next forward movement.

FIG. 10 is a cross sectional view of another embodiment of the present invention. In this embodiment, there is provided an assistant hydraulic pressure applying cylinder 9 capable of pressurizing and operating the piston rod of the hydraulic pressure-applying cylinder 41 of the hydraulic pressure-applying cylinder 4 for allowing the backrest 12 to move in the forward direction in maximum for thereby supporting the user's back when the user sits at a front side of the seat 11.

The above assistant hydraulic pressure-applying unit 9 includes an assistant support shaft 91 fixedly installed at a front side of the upper surface of the lower plate 2*c*, and a seesaw operation member (front side in the drawing) is connected to a lower surface of the intermediate plate 2*b*, and the other end (rear end in the drawing) is connected to the piston rod of the hydraulic pressure-applying cylinder 41.

In addition, in the above embodiment of the present invention, the piston rod of the hydraulic pressure-applying cylinder 41 may not be fixed to the lower plate 2*c*, but may be movable in the direction of the cylinder body.

Therefore, when the user sits at a front side of the seat 11, the weight of the user is intensively applied at the front side of the chair. In this case, the upper plate 2*a* and the intermediate plate 2*b* are supported by a plurality of spacers 57 and are engaged with the engaging bolt 58. Since the intermediate plate 2*b* and the lower plate 2*c* are supported by the upper and lower support plates 47*a* and 47*b* in which the spring 46 is elastically installed, the intermediate plate 2*b* is not horizontally compressed, but compressed in a forwardly tilted state. At this time, the front end of the seesaw operation member 92 connected to the lower side of the intermediate plate 2*b* is downwardly moved with respect to the upper end of the assistant support shaft 91, and the rear end of the same raises the piston rod of the hydraulic pressure-applying cylinder 41. As a result, the seesaw operation member 92 elastically supports the front side of the intermediate plate 2*b* based on a repulsive force caused as the piston rod of the hydraulic pressure-applying cylinder 41 is raised and compressed, so that an over tilting of the intermediate plate 2*b* is prevented. In addition, the seesaw operation member 92 further compresses the hydraulic pressure of the hydraulic pressure-applying cylinder 41. The hydraulic pressure of the hydraulic pressure-applying cylinder 41 is achieved based on the weight of the user and the compression operation of the seesaw operation member 91. The hydraulic pressure applied to the reciprocation operation cylinder 52 is increased. The backrest frame 3 is forwardly moved in maximum for thereby effectively supporting the back of the user sitting at the front side of the seat.

In addition, the front end of the seesaw operation member 92 of the assistant hydraulic pressure-applying unit 9 is divided into two parts that are widened in the left and right directions for thereby stably supporting the both sides of the lower side of the intermediate plate 2*b*.

INDUSTRIAL APPLICABILITY

As described above, in the present invention, when the backrest according to the present invention is adapted to all chairs, even when the user sits at an intermediate portion of the seat, the backrest is automatically moved in the forward direction for thereby supporting the user's back. Therefore, the user can naturally sit on the chair in the upright posture. In the present invention, even when the user sits at a certain portion of the seat of the chair, the user can always sit on the seat in the upright posture in a state that the user leans to the backrest. Therefore, the user can study or work for long time, sitting on the chair, for thereby protecting a user's backbone and helping a user's health. In particular, when the chair according to the present invention is adapted to children in growing age, young persons and adults as well as weak persons or patients, it is possible to effectively protect the backbone of the users.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A chair having a seat, a backrest and support legs, the backrest being automatically adjustable for thereby preventing various backbone-related diseases, comprising:

upper, intermediate and lower plates installed between the seat and the support legs at a certain interval therebetween in upper and lower directions;

a hydraulic pressure-applying means installed between the intermediate plate and the lower plate in such a manner that an elastic operation is achieved in the upper and lower directions, the hydraulic pressure-applying means including a hydraulic pressure-applying cylinder operating in such a manner that when a user sits on a chair, the intermediate plate is elastically compressed by weight of the user, and a hydraulic pressure is applied to a reciprocation operation cylinder installed between the upper plate and the intermediate plate, and when the user gets up from the seat, the compressed state of the intermediate plate is recovered to its original state, so that the hydraulic pressure supplied to the reciprocation operation cylinder is applied to the hydraulic pressure applying cylinder;

a guide box installed between the upper plate and the intermediate plate and horizontally installed on an upper surface of the intermediate plate in forward and backward directions;

a backrest moving means including:

the reciprocation operation cylinder horizontally installed in an interior of the guide box, and a piston rod extends as hydraulic pressure is inputted into the reciprocation operation cylinder and discharged from the hydraulic pressure-applying cylinder of the hydraulic pressure-applying means, and when the hydraulic pressure-applying cylinder collects hydraulic pressure the pressure is discharged from the reciprocation operation cylinder, the piston rod retracts; and a main operation member horizontally installed and passing through a movement elongated hole formed at both sides of the guide box in a direction perpendicular to the guide box and connected with a front end of the piston rod of the reciprocation operation cylinder and forwardly and backwardly moved within a moving range of the movement elongated hole of the guide box based on the forward and backward movements of the piston rod;

a backrest frame connected at both ends to the main operation member of the backrest moving means and forwardly and backwardly moved together with the main operation member; and an assistant operation member movably installed at a rear side between the upper plate and the intermediate plate and forwardly and backwardly moved together with the backrest frame in a state that both ends of the same are connected with the backrest frame.

2. The chair of claim 1, wherein in said hydraulic pressure-applying means, a certain fluid selected between oil or gas is injected into the hydraulic pressure-applying cylinder, and the hydraulic pressure-applying cylinder is connected in such a manner that a hydraulic pressure is supplied to the reciprocation operation cylinder of the backrest moving means through a hydraulic pressure line and is collected, and a hydraulic pressure control valve is connected with the hydraulic pressure line for controlling a flow of hydraulic pressure by opening and closing a pressure adjusting valve capable of adjusting a discharge amount of the hydraulic pressure and the hydraulic pressure line.

3. The chair of claim 1, wherein said backrest moving means includes:

a shaft support member fixed to the main operation member at both sides of the movement elongated hole of the guide box;

an operation shaft that passes through the movement elongated hole of the guide box, wherein both ends of the same are rotatably installed at the shaft support member through the movement elongated hole of the guide box;

a stopper that is installed in the interior of the guide box in a state that it is fixed to the operation shaft;

a pair of roller support members fixed to both sides of the main operation member; and a guide roller that is rotatably installed at the roller support member and supports a protruded guide rail at both lower sides of the upper plate in parallel and rolls along the guide rail as the main operation member is moved.

4. The chair of claim 3, wherein in said stopper of the backrest moving means, a moving roller is rotatably installed in the operation shaft in a roller installation hole and forwardly and backwardly moves along a moving path formed at a lower center portion of the guide box, and backward and forward movement prevention driving gears are installed at an upper surface of a forward side of the stopper and at a lower surface of a backward side of the same in a slanted state for thereby stopping the stopper.

5. The chair of claim 1, wherein backward and forward movement prevention fixing gears engaged with the backward and forward movement prevention driving gears formed in the stopper are formed in upper and lower surfaces of the inner side of the guide box for thereby stopping the stopper.

6. The chair of claim 1, wherein a rotary shaft is installed at a lower side of the backrest frame, wherein both ends of the rotary shaft are rotatable with respect to the backrest frame; and a detection lower backrest is provided separately from the backrest on the rotary shaft and is rotated in a state that it is protruded in the direction of the seat when a user is not seated on the chair, or when a certain space is formed between the user's hip portion and the backrest, and when the user sits on the chair, the backrest frame is moved in the forward direction, so that the detection lower backrest first contacts with the user's hip portion before the backrest contacts with the back portion of the user and the detection lower backrest is thereby rotated, thus rotating the rotary shaft; and a stopper operation wire connects an end of one side of the rotary shaft and one end of the operation shaft of the main operation member and transfers a rotational force when the rotary shaft is rotated, so that the stopper performs a movement prevention operation and movement release operation.

7. The chair of claim 1, wherein a rotary shaft is installed at a lower side of the backrest frame, wherein both ends of the rotary shaft are rotatable with respect to the backrest frame; and a detection lower backrest is provided separately from the backrest on the rotary shaft and is rotated in a state that it is protruded in the direction of the seat when a user is not seated on the chair, or when a certain space is formed between the user's hip portion and the backrest, and when the user sits on the chair, the backrest frame is moved in the forward direction, so that the detection lower backrest first contacts with the user's hip portion before the backrest contacts with the back portion of the user and the detection lower backrest is thereby being rotated, thus rotating the rotary shaft; and a hydraulic pressure control wire connects an end of one side of the rotary shaft and a hydraulic pressure control valve installed in the hydraulic pressure line for thereby opening and closing the hydraulic pressure control valve.

8. The chair of claim 1, further comprising an assistant support shaft vertically fixed to an upper surface of the lower plate, and an assistant hydraulic pressure applying means that is provided between the intermediate plate and the lower plate and includes a seesaw operation member being rotatably attached to an upper end of the assistant support shaft wherein a front end of the same is connected with a lower surface of a front side of the intermediate plate, and a rear end of the same is connected with a piston rod of the hydraulic pressure applying cylinder.

* * * * *